US006401957B1

(12) United States Patent
Przytulla

(10) Patent No.: US 6,401,957 B1
(45) Date of Patent: Jun. 11, 2002

(54) BARREL WITH PLASTIC LID

(75) Inventor: Dietmar Przytulla, Kerpen (DE)

(73) Assignee: Mauser-Werke GmbH, Bruhl (DE)

( * ) Notice: Subject to any disclaimer, the term of this patent is extended or adjusted under 35 U.S.C. 154(b) by 0 days.

(21) Appl. No.: 09/509,187

(22) PCT Filed: May 26, 1999

(86) PCT No.: PCT/EP99/03640

§ 371 (c)(1),
(2), (4) Date: May 9, 2000

(87) PCT Pub. No.: WO99/61323

PCT Pub. Date: Dec. 2, 1999

(30) Foreign Application Priority Data

May 28, 1998 (DE) ..... 298 09 484 U

(51) Int. Cl.[7] ..... B65D 45/32; B65D 43/04

(52) U.S. Cl. ..... 220/319; 220/654; 220/798; 220/378

(58) Field of Search ..... 220/319, 320, 220/321, 782, 783, 795, 797, 806, 378, 654, 648, 798

(56) References Cited

U.S. PATENT DOCUMENTS

| | | | | | |
|---|---|---|---|---|---|
| 3,510,023 | A | * | 5/1970 | Ullman et al. | 220/319 |
| 3,664,544 | A | * | 5/1972 | Hammes | 220/319 |
| 3,696,962 | A | * | 10/1972 | Fehres et al. | 220/319 |
| 4,709,833 | A | * | 12/1987 | Granberg et al. | 220/319 |
| 5,593,060 | A | * | 1/1997 | Przytulla | 220/319 |
| 5,881,898 | A | * | 3/1999 | Irwin et al. | 220/319 |

* cited by examiner

*Primary Examiner*—Nathan J. Newhouse
(74) *Attorney, Agent, or Firm*—Pennie & Edmonds LLP

(57) ABSTRACT

A lidded plastic barrel (10) consisting of a barrel body (12), a barrel lid (14) and a clamping ring or ferrule (16). The U-channeled rim (20) of the barrel lid (14) includes an additional, rotationally symmetrical sealing web (36) and a gasket (22) is positioned between the outer circular side wall (26) of the lid and the said sealing web (36). Between the sealing web (36) and the inner circular side wall (28) of the lid an annular recess (38) opens up toward the bottom while the sealing web (36) and the inner circular side wall (28) are spaced apart and are mutually connected by way of an upper flange (40).

26 Claims, 7 Drawing Sheets

FIG.10
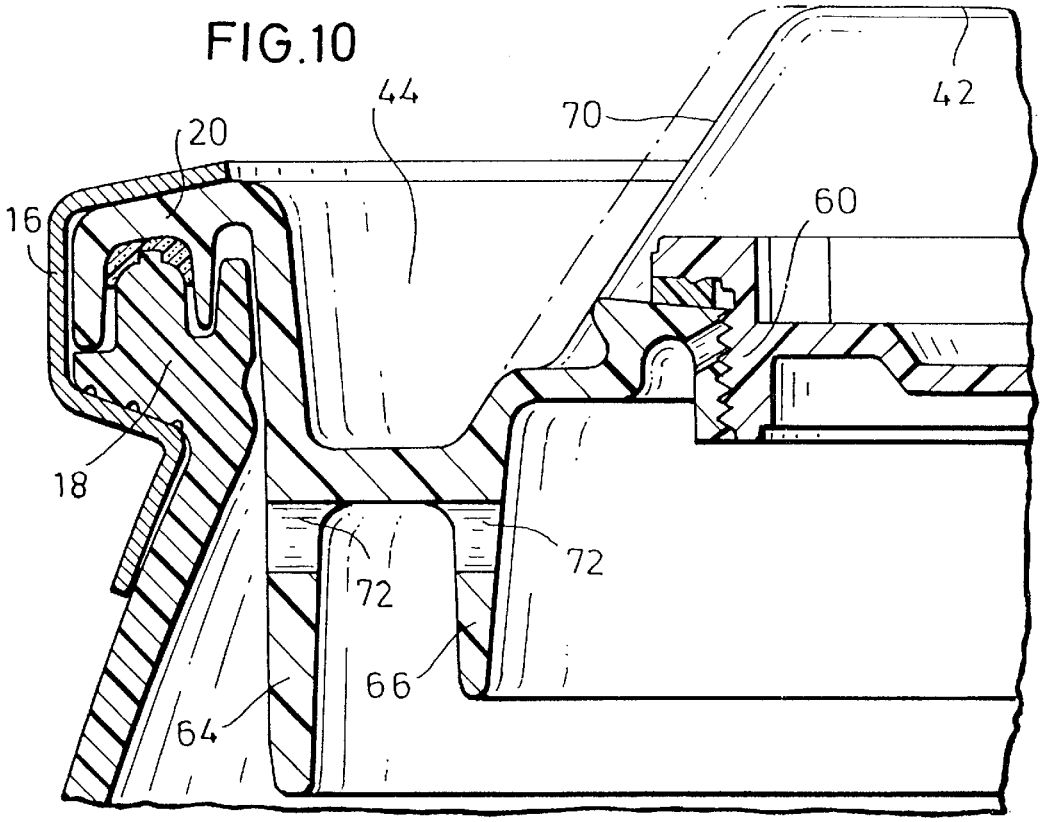
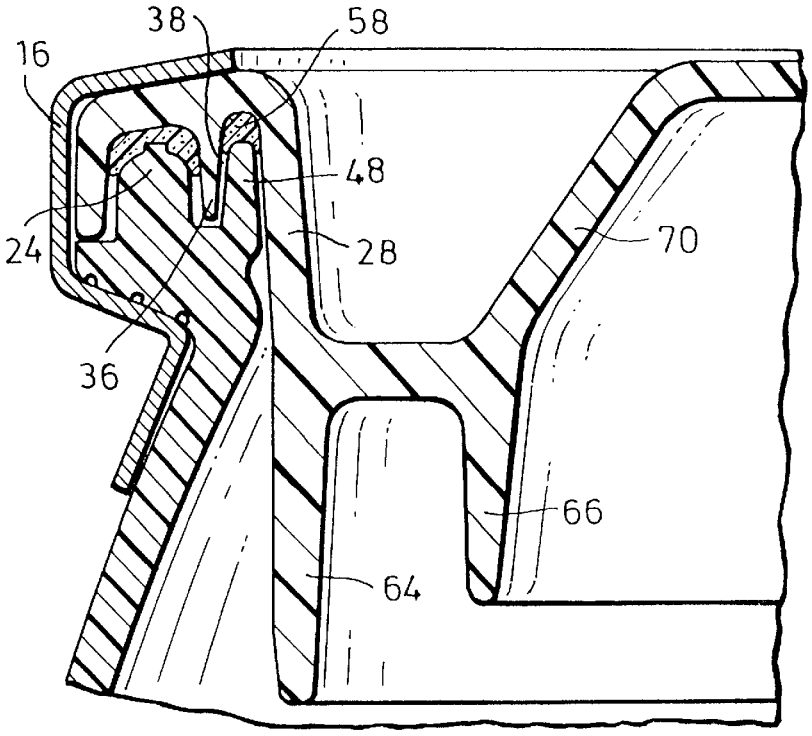
FIG.11

BARREL WITH PLASTIC LID

This invention relates to a lidded plastic barrel comprised of a barrel body covered by a barrel lid with a gasket insert and a clamping ring as specified in patent claim 1. A similar lidded barrel has been described earlier for instance in U.S. Pat. No. 5,427,264.

BACKGROUND OF THE INVENTION

In a conventional lidded plastic barrel the lid gasket is held in place between the vertical outer side wall and the vertical inner ring of the lid (ref. FIG. 2). In drop tests (=dropping the barrel) and internal-pressure tests the central panel area of the lid tends to bend upwards, causing the vertical inner ring of the lid to bend inwards and upwards from its vertical position which in turn removes the pressure from the gasket, breaking the seal between the gasket and the barrel rim and leading to possible leaks in particularly affected locations.

SUMMARY OF THE INVENTION

It is the objective of this invention to introduce a lidded barrel of the general type referred to, in which a reinforced junction between the barrel lid and the rim of the barrel mouth provides an improved seal especially when exposed to high internal pressure or when the barrel is dropped (pressure surge on impact).

In the lidded barrel according to this invention, the barrel lid is provided within its U-channel-shaped rim with an additional rotationally symmectric sealing web, the gasket is positioned between the outer circular side wall of the lid and the sealing web, an annular recess between the sealing web and the inner circular side wall of the lid opens toward the bottom, and the sealing web and the inner side wall of the lid are spaced apart and mutually connected only via an upper flange. With this desirable enhancement, the barrel lid offers a distinct improvement over prior-art designs in that even in the case of substantial deformation of the vertical inner ring of the lid, bending it inwards and upwards, the sealing web remains vertical so that the pressure on the seal is not eased. Indeed, the vertical web bounding on the inner face of the gasket inherently provides better axial and radial retention of the gasket, so that, given less deformation in the area of the seal, it securely seals the barrel lid on the rim of the barrel mouth even under conditions of extreme impact on the lidded barrel.

In a variation of the proposed solution, the bottom surface of the lid is provided in juxtaposition to the inner, circular, peripheral side wall with a reinforcing element extending in the circumferential direction and having a self-contained cross section that is either hollow or foam-filled. This hollow or foam-filled reinforcing element may be formed by gas injection at the time the molten plastic is injected into the mold. Alternatively, the reinforcing element may be in the form of a separate, prefabricated, circular, hollow, self-contained plastic part that is fused to the barrel lid. By means of this torsion-resistant reinforcing element around the perimeter of the barrel lid, inserting and supporting itself on the inside of the barrel mouth, a deformation of the lid will not relieve the pressure on the lid gasket to a point beyond an acceptable level that would break the seal. In an enhanced design version of the invention, the upper inside rim of the barrel mouth is provided, in addition to and at a short distance from the circular sealing web, with a vertical upright, circular ridge which, when the barrel lid is mounted and closed, engages in the annular recess between the sealing web and the inner circular side wall of the lid. Thus, even if the inner ring of the lid is substantially deformed, the additional vertical sealing web is no longer exposed to possible inward or upward deformation since on the upper barrel rim the added vertical ridge reaches behind the additional vertical sealing web, firmly supporting it. When the barrel lid is mounted, closed and clamped tight by means of a ring, the upright vertical ridge and the downward-pointing sealing web overlap by at least 5 mm. The upright circular ridge may be in the: form of spaced-apart segments or of a continuous annular profile in which latter case it is preferably provided at its base with a perforation through which any possibly present liquid can drain off.

In a preferred embodiment, the recess between the sealing web and the inner annular side wall holds an additional circular gasket which, in the closed state of the barrel lid against the upper edge of the upright, circular ridge, provides a supplementary seal between the rim of the barrel mouth and that of the barrel lid. This further enhances the sealing capacity in the event of an extreme impact.

The lidded barrel according to this invention additionally offers the following significant features and advantages:

- the additional vertical circular ridge profile on the barrel body consists of partly spaced segments, forming gaps through which water can drain off;
- the additional vertical circular ridge is elongated so as to provide enhanced support to the added vertical sealing web;
- in conjunction with a gasket in the barrel lid the additional, vertical, circular ridge on the barrel body supplements the seal between the barrel lid and the rim of the barrel mouth;
- the connecting flange of the inner lid panel on the inside of the U-channel-shaped lid perimeter is positioned at or below the level of the lower edge of the outer side wall of the lid;
- the connection of the inner lid panel to the inside of the U-channeled lid perimeter is made by way of a an essentially U-shaped, flat-base grasping groove, open towards the top, with the height of the inner lid panel or at least the central area of the lid panel being essentially aligned with, or protruding upwards beyond, the elevational plane of the upper lid perimeter.

BRIEF DESCRIPTION OF THE DRAWINGS

The following describes and explains this invention in more detail with the aid of design examples illustrated in the drawings in which:

FIGS. 5–11 show additional design versions of the barrel lid perimeter, including the barrel mouth and the ring;

In FIG. 1 the reference number 10 identifies a lidded barrel incorporating a barrel body 12, a barrel lid 14 and a tensioning ring 16. The barrel lid 14 consists of a high-density thermoplastic material (HDPE) and is produced by injection-molding. The barrel body 12 as well consists of a high-density thermoplastic material (HDPE) and is produced by injection molding but preferably by blow-molding. The ring 16 is made of sheet metal or a plastic material. The perimeter or rim of the lid and the rim of the barrel body are provided with special features according to this invention. FIG. 2 illustrates the deformation effect of an increased internal pressure especially on the lid 14 of a conventional lidded barrel. In this lidded barrel, the upper, solidly swaged and expanded barrel-mouth rim 18 of the barrel body 12 is provided with a circular sealing web 24 while the barrel lid 14 features an inverted-U-shaped rim 20. The rim 20 has an outer, circular side wall 26 and an inner circular side wall 28, with a gasket 22 positioned (i.e. foamed in or mounted) between the two side walls 26, 28. The ring 16 has an essentially trapezoid cross section open toward the inside and in its locked state, its upper leg 30 engages the inverted-U-shaped rim 20 from above while its lower leg 32 reaches around a radially extending portion or lip 34 of the barrel shell which lip protrudes outward in essentially radial fashion in the area of the upper rim 18 of the barrel mouth. When the ring 16 is in its closed state, the lid gasket 22 is pressed against the sealing web 24 of the upper rim 18 of the barrel mouth, thus providing a sealing effect. The internal pressure causes the central panel 42 of the lid 14 to strongly bulge outward in an axial direction. This pulls the inner side wall 28 of the lid perimeter 20 inward—as indicated by the arrows—and lifts or pushes it off. As a result the pressure on the inner surface of the gasket 22 is progressively reduced, the gasket recedes inward and loses it sealing capability. The situation is similar when a barrel is dropped on the lid end, with most of the buckling occurring at the rim of the barrel mouth. This loss of sealing capacity is counteracted by a design version of this invention illustrated in FIG. 3 in that, between the outer side wall 26 and the inner side wall 28 of the inverted-U-rim 20 of the lid, an additional sealing web 36, axially pointing downward, is provided. The lid gasket 22 is thus held in place between the outer side wall 26 and the added sealing web 36. The sealing web 36 is positioned at a small distance from the inner side wall 28, leaving only a gap of about 2 to 4 mm, and is elastically connected to it by way of an upper, relatively thin flange 40. Underneath it, the flat or cambered inner lid panel 42 makes contact with the lower edge of the inner side wall 28. The attachment of the inner lid panel 42 on the inside of the U-shaped lid perimeter 20 may be located at or—as shown in FIG. 4—below the level of the lower edge of the outer side wall 26. Additionally provided on the underside of the lid panel 42 may be two axially downward-pointing outer and inner ring sections 64, 66 (ref. FIG. 5) or a self-contained, hollow, circular plastic element 56 (FIG. 6) serving as the reinforcing element 54.

FIG. 4 shows another design example of a barrel lid 14 together with the clamping ring 16 and the simple barrel-mouth rim 18 of a barrel body 12. In this case the barrel lid is provided with a grasping groove 44 and a raised inner lid panel 42. For engaging the upper claw of a barrel-grasping tool the grasping groove 44 is at least 15 mm deep and has a flat base 46 with a radial width of at least 10 mm. Laterally extending upwards from the inside of the groove base 46 in essentially axial or conical fashion is an annular element 70 serving as the connection to the central lid panel 42 that is of a smaller diameter. As shown in the illustration, the height of the inner lid panel 42 or at least of the cambered central area of the lid panel 42 may be on about the same level as, or protruding upwards beyond, the upper rim 20 of the lid (ref. FIG. 10).

FIG. 5 shows a preferred design example with a reinforced barrel-mouth rim. In this case, the upper rim 18 of the barrel mouth is provided on the inside, in addition to and at a distance from the circular sealing web 24, with a vertical, upright annular profile member 48 which, when the barrel lid is mounted and closed, engages in the circular recess 38 between the sealing web 36 and the circular inner side wall 28. Between the upright annular profile member 48 and the sealing web 24 on the inside of the upper rim 18 of the barrel mouth circular retaining groove is provided in which engages the sealing web 36 of the barrel lid. For adequate mutual support, the upright annular profile 48 and the sealing web 36 overlap in the axial direction by at least 5 mm when the barrel lid 14 is mounted and closed and secured with the clamping ring 16. In this design version the flange 40 connecting the inner side wall 28 to the upper lid perimeter 20 above the recess 38 is largely elastic or flexible for instance by means of a hinge-like configuration. In this case the upright annular profile 48 is in the form of a continuous ring 48 with at least one perforation 50 through its base, so that any liquid content that might have entered the retaining groove can drain back into the barrel.

FIG. 6 shows a modified design example in which the upright annular profile 48 consists of ring sections circularly spaced apart, again preventing any liquid content from accumulating in the retaining groove 52. In this case, the contact surface for the lower leg 32 of the ring 18 is broadened by virtue of the fact that the lip 34 of the barrel shell is provided with a lip extension 62 which essentially protrudes outwards by at least 3 mm. The inner circular side wall 28 is extended downwards past the point of connection of the central lid panel 42 and past the base 46 of the grasping groove 44 to form the axially outer section of the inner ring. In addition, a second inner ring section 66 is located on the underside of the barrel lid at a radial distance of at least 10 mm from the axially outer ring section 64. With the barrel lid mounted as shown in the illustration, the axially outer section 64 may protrude into the barrel body by at least 5 more mm than the second section 66 of the inner ring. In a desirable design configuration and for the purpose of reinforcing the outer rim of the barrel mouth, the ring 16 is extended on its lower leg 32, in an essentially axial direction, by an extension skirt 68 which makes contact with the outside wall of the barrel. This extension skirt 68 preferably engages and retracts into an indentation in the outside barrel wall in such fashion that it is flush with the outer barrel-wall surface and will not catch the lower claw of a barrel-grasping device as that slides up into the grasping position. An added feature of this invention, shown in the illustration, permits the stacking of for instance three such lidded barrels one on top of the other in such fashion that, with the lids closed, the outer side wall 26 sits on the lip extension 62 and the sealing web 36 sits on the base of the retaining groove 52, leaving in the axial direction above the sealing web 24 a gap of at least 2 mm for the gasket 22, so that even in the case of overloading the gasket 22 cannot be permanently damaged.

FIG. 7 shows a design example according to this invention in which the underside of the lid is provided in the circumferential direction with a reinforcing element 54 which, with a hollow, self-contained cross section, connects to the inner circular side wall 28 of the lid perimeter 20. This hollow but torsion-resistant reinforcing element 54 may be produced by the essentially conventional gas injection method during the injection-molding process.

FIG. 8 shows a design example of a self-contained, foam-filled reinforcing element 54. The foam-filled reinforcing element can be produced by injecting a foaming agent into the mold, i.e. the cavity for the reinforcing element.

FIG. 9 shows a design variation whereby the reinforcing element 54 is provided by fusing a separate, prefabricated, annular, hollow but self-contained plastic component 56 to the lid (also refer to FIG. 3). In this design example, the sealing web 24 includes a small, upright cam strip 70 which is pressed into the gasket 22, further securing the latter against lateral slippage.

FIG. 10 shows a design example in which the inner lid panel 42 is provided with at least one lateral 2-inch or 3-inch bung 60. In the same fashion a bung of an appropriate size could be located in the center of the inner lid panel 42. The barrel lids according to this invention are of a relatively large diameter greater than 11.8". In the case of an essentially cylindrical lidded barrel having a capacity of 35 US gallons the outer lid diameter is about 18.6" for a barrel height of about 33.9" while for a lidded barrel (per FIG. 1) about 35.4" high and having a capacity of 55 US gallons the outer lid diamater is about 22.7". The mouth of barrels of this type is about 15% wider than that of conventional, bellied lidded barrels. With smaller, more rigid lids (less than 8") or screw caps the bulging of the lid due to internal pressure is less of a problem. In the lid designs illustrated, the base of the two ring sections 64, 66 is provided with at least one perforation 72. Thus, when the lidded barrel is completely filled with a liquid, for instance through the bung 60, the air can escape behind the ring sections. By the same token, when the barrel is tilted in a slightly upended position for completely emptying it, these perforations 72 permit the drainage of any residual liquid from behind the ring sections 64, 66.

FIG. 11 shows a preferred design example in which the recess 38 between the sealing web 36 and the inner circular side wall 28 contains an additional, second circular gasket 58 which, when the barrel lid 14 in its closed state pushes against the upper edge of the annular profile 48, provides an additional seal between the rim of the barrel mouth and the rim of the barrel lid. This dual seal offers particularly good protection in the case of internal pressure surges for instance when the barrel is dropped.

FIG. 12*a* is a schematic illustration of a barrel subjected to severe deformation at the time of impact on the ground (shell impact) along the axis of impact indicated by the line I—I. FIG. 12*b* shows in a partial, cross-sectional illustration the effect of the mutual stress between the rim of the lid and the rim of the barrel body at that particular point. The impact energy causes the inner side wall 28 of the lid 14 to push against the inner wall of the barrel-mouth rim 18 while the sealing web 36 pushes laterally against the sealing web 24 on the rim of the barrel mouth. Even though the central lid panel 42 bulges strongly, there is no great danger at this point of the pressure on the gasket being relaxed to where the seal of the lidded barrel would be broken. That danger is more likely to be encountered in a barrel which, as schematically shown in FIG. 13*a* is subject to maximum deformation at ground impact (shell impact) in the areas of the line II—II at about 45° relative to the axis of impact. FIG. 13*b* is a partial, cross-sectional illustration showing the effect of mutual stress of the barrel-lid rim and the barrel-body rim at that particular, critical point. In the radial direction the barrel body 12 is less rigid than the barrel lid 14. Especially in the area of the barrel-mouth rim 18 the barrel body 12 bends strongly to the outside, adding to the load on the connection between the rim of the barrel and the rim of the lid. The barrel lid 14 cannot stretch in the same manner and it is pulled very flat especially in the area of the grasping groove 44 and that particular point of attachment of the lid panel 42. It used to be that the lid gasket 22 would be pressure-relieved from the inside, causing the rim of the lid to slip out from under the ring 16. With the lid design according to this invention this is no longer the case since the outer side wall 26 is laterally held in positive, flush position on the upper barrel rim 18 by the sealing web 24 while the sealing web 36 on the lid is laterally held in place by the annular profile 48. In other words, the rim of the lid is doubly supported and neither the seat of the gasket 22 nor its immediately neighboring components change their relative position, thus fully and in desirable, uncompromised fashion keeping the seal intact.

Figure 1:
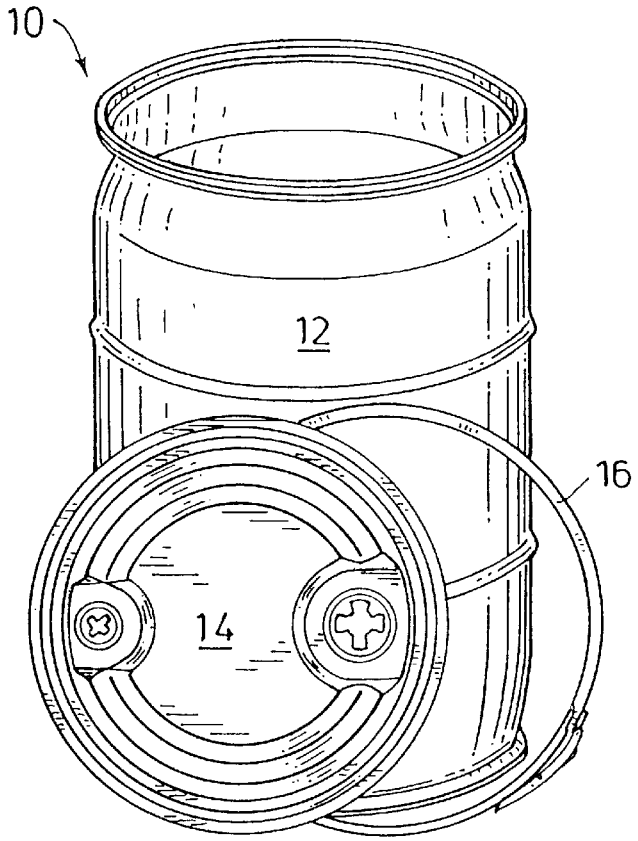
FIG. 1 is a perspective view of a lidded barrel according to this invention (Vanguard FRH barrel II)
Figure 2:
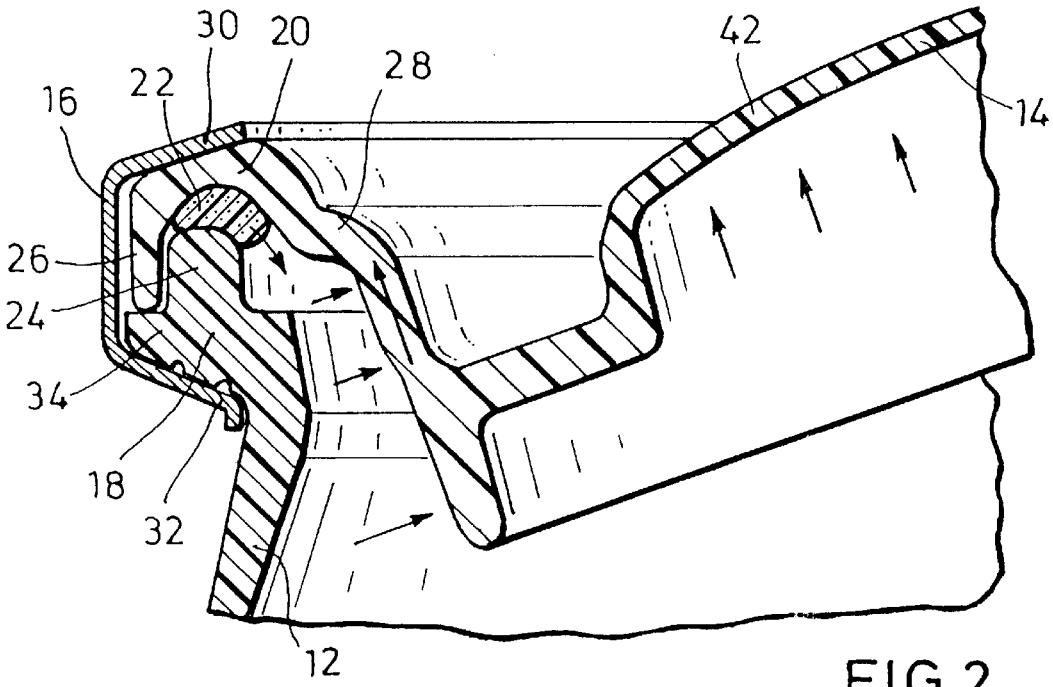
FIG. 2 is a partially sectional view of the junction between the barrel lid perimeter and the barrel mouth of a conventional lidded barrel.
Figure 3:
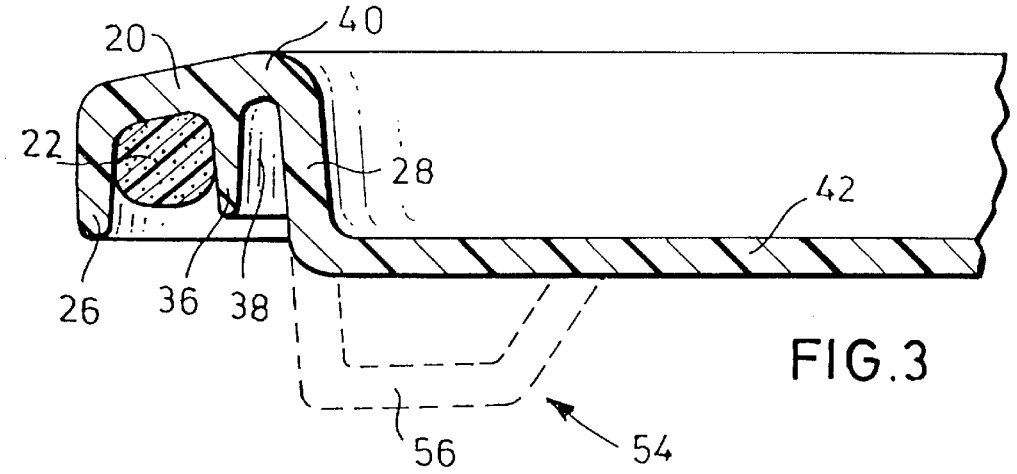
FIG. 3 is an enlarged, partially sectional view of the barrel-lid perimeter of a simple barrel lid according to this invention.
Figure 4:
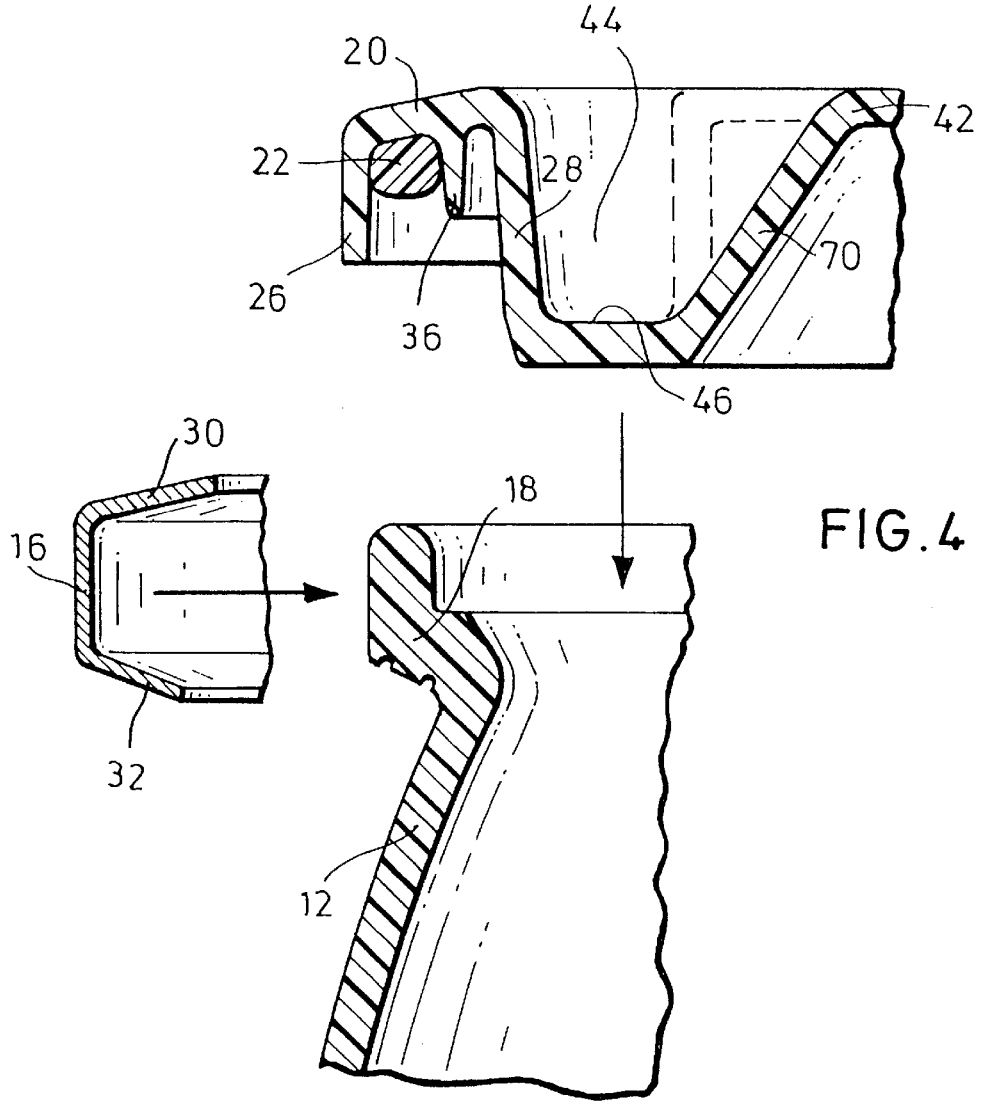
FIG. 4 is an enlarged, partially sectional view of another barrel-lid perimeter, showing the barrel mouth and the ring.
Figure 5:
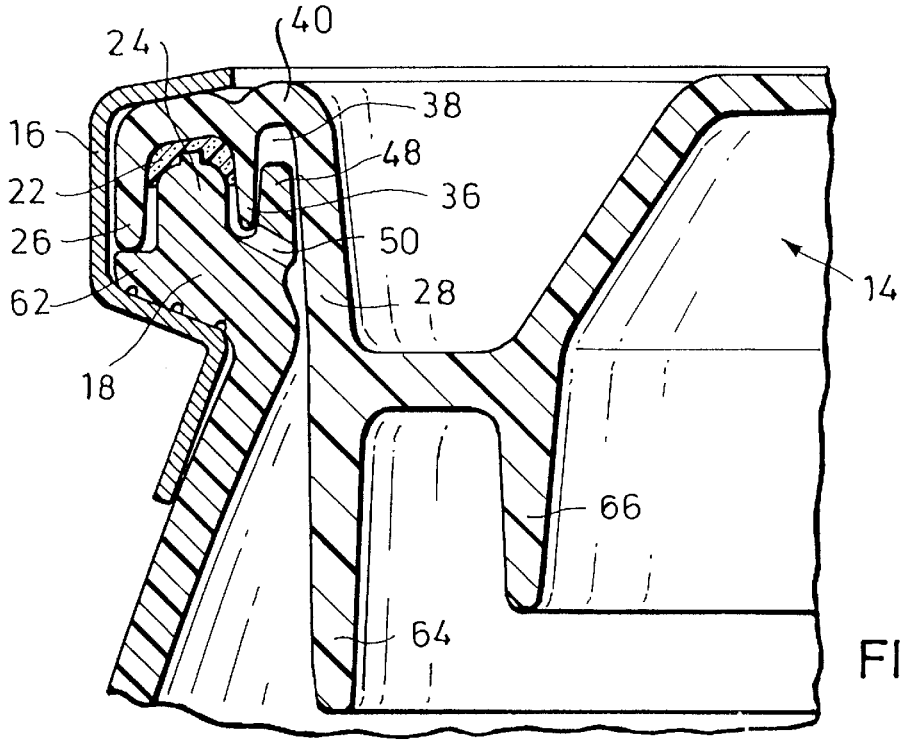
Figure 6:
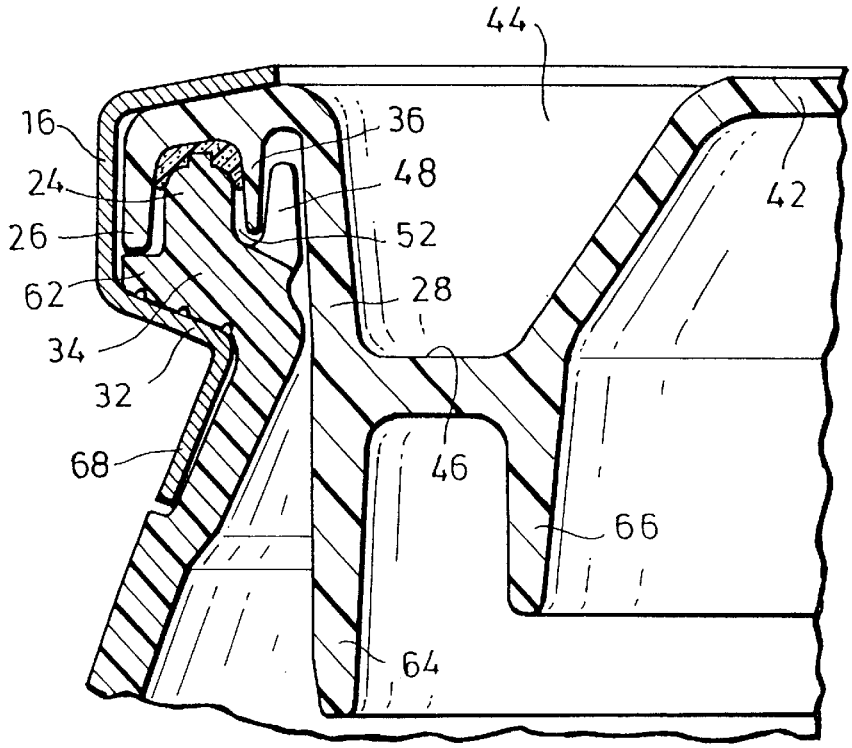
Figure 8:
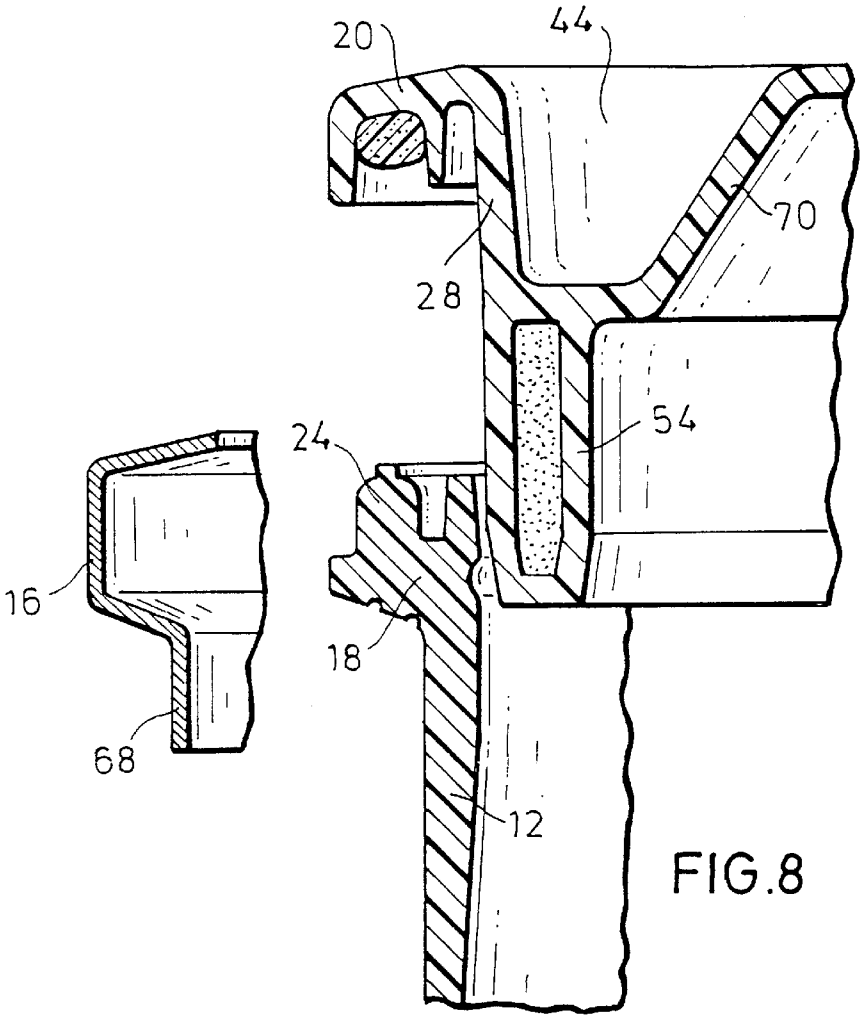
Figure 7:
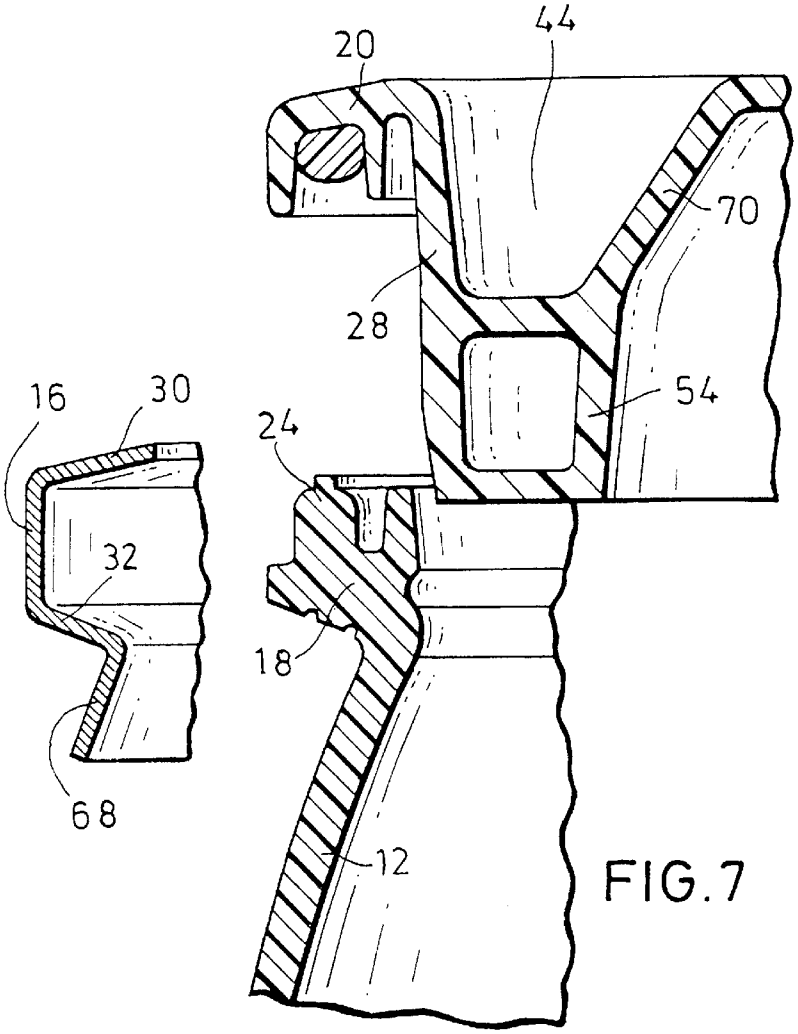
Figure 9:
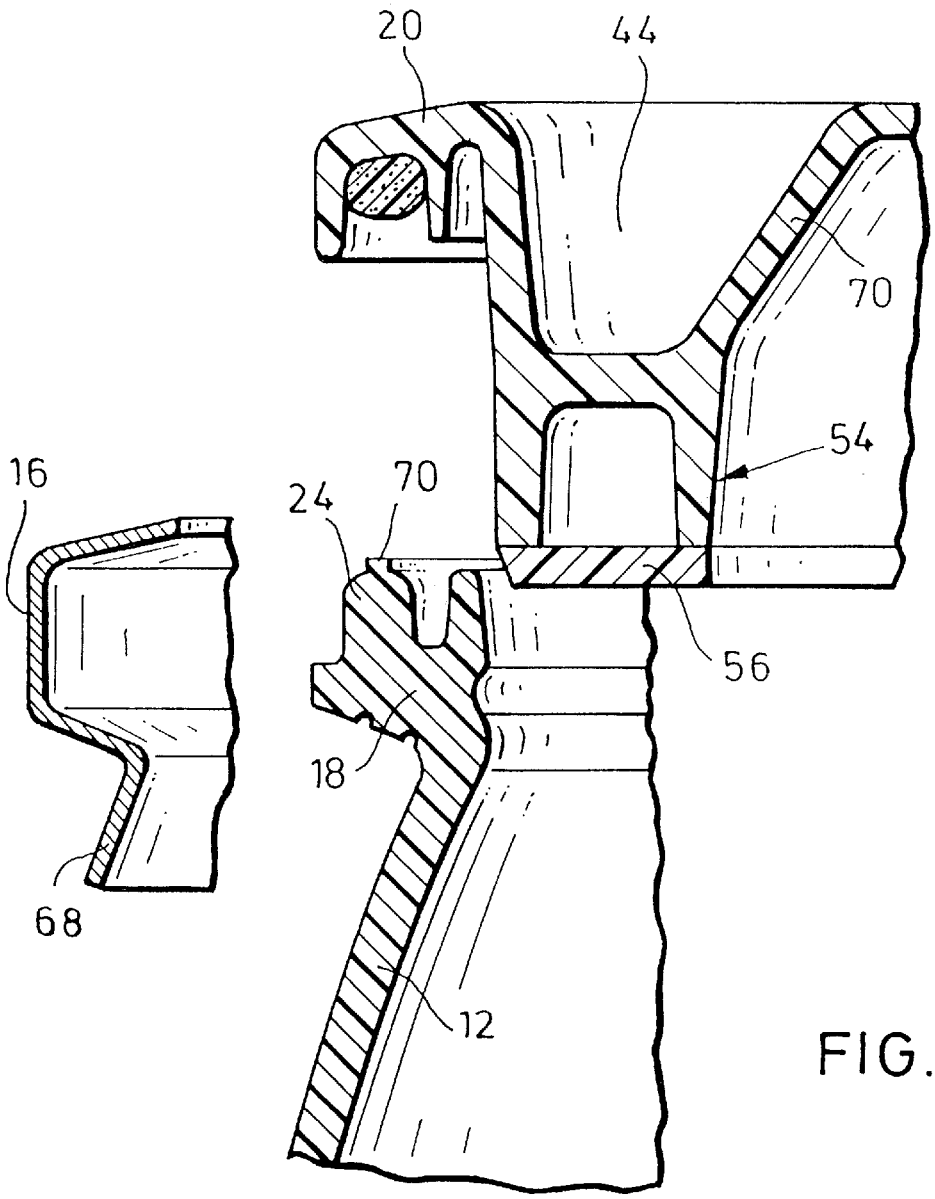
Figure 13A:
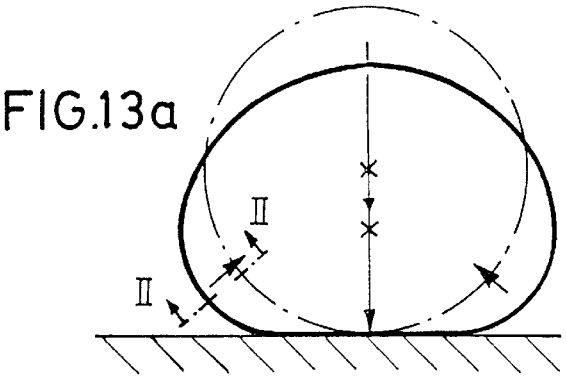
FIG. 13*a* is a schematic illustration of a barrel as deformed at the time of impact on the ground (surface-pressure drop test)
Figure 13B:
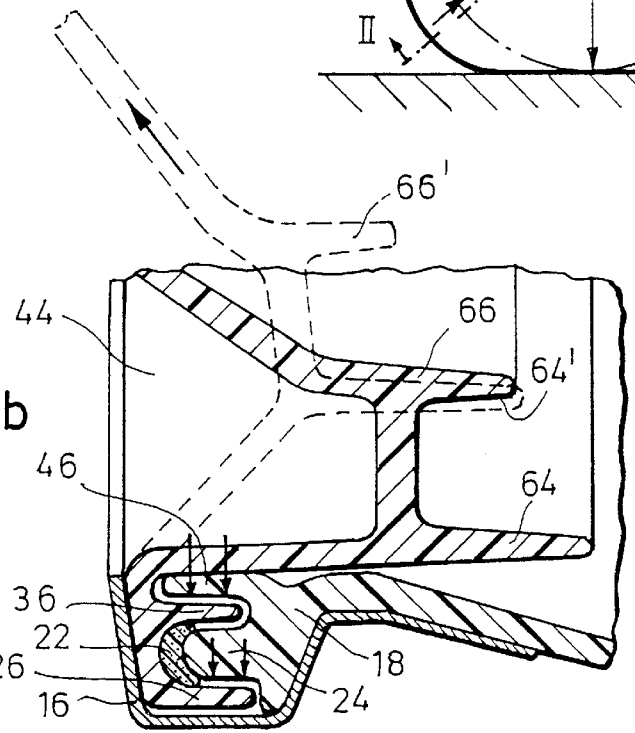
FIG. 13*b* is a partially sectional view at about 45° II—II relative to the axis of impact of the junction between the barrel-lid perimeter and the barrel mouth per FIG. 13*a*.
Figure 12A:
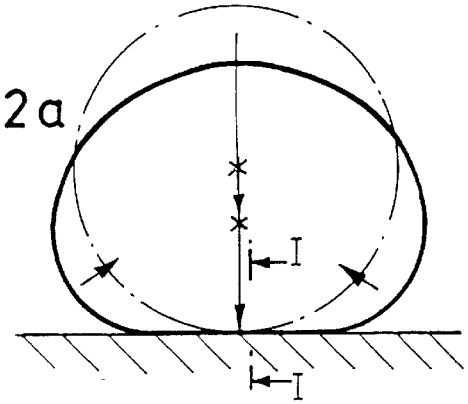
FIG. 12*a* is a schematic illustration of a barrel as deformed at the time of impact on the ground (surface-pressure drop test)
Figure 12B:
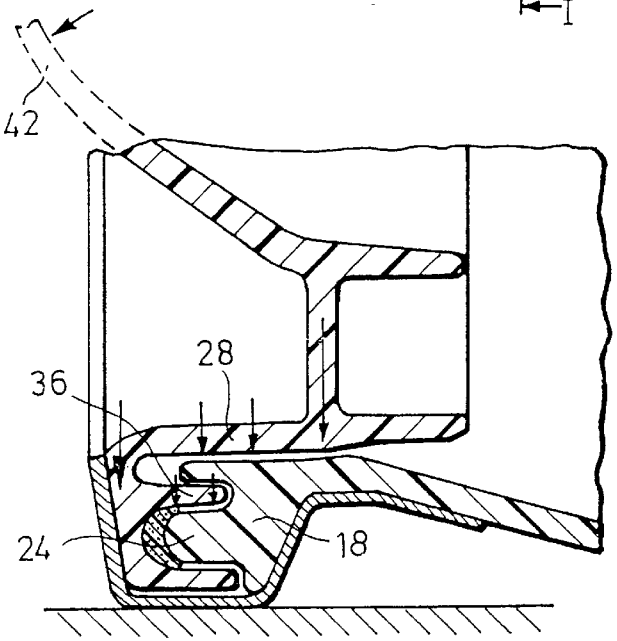
FIG. 12*b* is a partially sectional view showing the axis of impact I—I of the junction between the barrel-lid perimeter and the barrel mouth per FIG. 12*a;*

As a matter of course, the special design features shown in association with the various individual design examples can be combined in any suitable manner.

List of Reference Numbers

10 Lidded barrel
12 Barrel body
14 Barrel lid
16 Clamping ring
18 Rim of barrel-mouth (12)
20 Rim/perimeter of lid (14)
22 Gasket (20)
24 Sealing web (20)
26 Outer side wall (20)
28 Inner side wall (20)
30 Upper leg (16)
32 Lower leg (16)
34 Lip (12)
36 Sealing web (20)
38 Recess (28, 36)
40 Flange (28, 36)
42 Inner lid panel
44 Grasping groove
46 Groove base (44)
48 Annular profile (18)
50 Perforation (48)
52 Retaining groove (18)
54 Reinforcing element (42)
56 Annular plastic element
58 Second lid gasket
60 Lateral bung
62 Lip extension (34)
64 Outer section of inner ring
66 Inner section of inner ring
68 Extension skirt (16)
70 Cam strip (24)
72 Perforation (64, 66)
74
76
78
80

What is claimed is:

1. In a lidded plastic barrel (10) comprising a barrel body (12), a barrel lid (14) having an outer periphery, and a clamping ring (16), in which the barrel body (12) has an open upper end defined by an upper rim (18) having an upstanding first sealing web (24), and the barrel lid (14) includes an inverted-U-shaped rim (20) defined by an upper end having an outer downwardly extending side wall (26) and a spaced inner downwardly extending side wall (28), the clamping member (16), having an upper leg (30) and a lower leg (32) and when in the clamped state engages with its upper leg (30) over the U-shaped rim (20) of the barrel lid and with its lower leg (32) under a downwardly facing surface of a radially extending part of the rim (18), near the upper end of the barrel, the improvement comprising:

a second sealing web (36) disposed on said lid 14 and extending downwardly between said outer and inner side walls (26, 28) to define a downwardly facing recess (38) between the second sealing web (36) and the inner side wall (28) wherein:

the upper rim (18) of the barrel body (12) includes an upstanding member (48) spaced radially inwardly of said first sealing web (24) and disposed in said downwardly facing recess (38), when the barrel lid (14) is positioned on the upper end of the barrel body (12).

2. The lidded barrel of claim 1 wherein:

the upstanding member (48) includes a plurality of upstanding sections spaced from each other around the upper rim (18) of the barrel body (12).

3. The lidded barrel of claim 1 wherein:

the upstanding member (48) extends continuously around the upper rim (18) of the barrel body (12).

4. The lidded barrel of claim 1 further comprising:

a second sealing gasket (58) disposed within said recess (38) and engaging against an upper end of said upstanding member (48) when the barrel lid (14) is positioned on the upper end of the barrel body (12).

5. The lidded barrel of claim 1, wherein:

the upper flange (40) is flexible to provide a hinge-like configuration.

6. The lidded barrel of claim 1 wherein:

said lid (14) includes an inner lid panel (42) connected to the rim (18) of lid (14) at or below the level of the outer side wall (26).

7. The lidded barrel of claim 1 wherein:

the clamping ring (16) includes an axial extension skirt (68) extending from said lower leg of the clamping ring (16) for engagement with the barrel body (12) when clamped onto said lid (14) and barrel body (12).

8. The lidded barrel according to claim 1 further comprising:

a first sealing gasket (22) positioned on said lid (14) between said outer and inner side walls (26, 28) for engagement with said first sealing web (24), when the barrel lid (14) is positioned on the upper end of the barrel body (12).

9. The lidded barrel of claim 8 wherein:

the second web (36) is spaced from said outer and inner side walls (26, 28) and is connected to said inner side wall (28) by an upper flange (40) defining an upper end of said recess (38).

10. The lidded barrel of claim 1 wherein:

the upstanding member (48) is spaced from said first sealing web (24) to define a retaining groove (52) having a bottom and in which the second sealing web (36) is disposed when the barrel lid (14) is positioned on the upper end of the barrel body (12).

11. The lidded barrel of claim 10 wherein:

the upstanding member (48) overlaps the second sealing web (36) by at least 5 mm, when the second sealing web (36) is disposed within said retaining groove (52).

12. The lidded barrel of claim 1 wherein:

said lid (14) includes an inner lid panel (42) spaced from the rim (18) of said lid (14) by a U-shaped upwardly facing groove (44) formed in said lid (14).

13. The lidded barrel of claim 12 wherein:

said groove (44) includes a base (46) connected to a bottom end of said inner side wall (28); and said inner lid panel (42) is disposed at or above the level of the upper end of the rim (20) of the lid (14).

14. The lidded barrel of claim 1 wherein:

said lid (14) includes an inner lid panel (42) having at least one bung (60) therein.

15. The lidded barrel of claim 14 wherein:

said bung (60) is centrally located in said inner lid panel (42).

16. The lidded barrel of claim 1 wherein:

the radially extending part of the rim (18) extends radially beyond the first sealing web (24) to define an extension (62) disposed below said outer side wall (26) of the barrel lid (14) when the barrel lid (14) is positioned on the upper end of the barrel body (12).

17. The lidded barrel of claim 16 wherein:

the outer side wall (26) of the barrel lid (14) rests on said extension (62) and said second sealing web (36) rests on the bottom of the retaining groove (52), when the barrel lid (14) is positioned on the upper end of the barrel body (12) and another barrel or barrels are stacked thereon, so as to provide a space for said first sealing gasket (22) between the first sealing web (24) and the upper end of the rim (20) of the barrel lid (14).

18. The lidded barrel of claim 1 wherein:

said lid (14) includes an inner lid panel (42) connected to a bottom end of said inner side wall (28); and an outer ring member (64) is connected to the bottom end of the inner side wall (28), said outer ring member extending downwardly into said barrel body (12) when said lid (14) is positioned on the upper end of said barrel body (12).

19. The lidded barrel of claim 18 wherein:

said barrel lid (14) includes a downwardly extending inner ring member (66) spaced radially inwardly from said outer ring member (64).

20. The lidded barrel of claim 19 wherein:

said outer ring member (64) extends downwardly beyond said inner ring member (66).

21. In a lidded plastic barrel (10) comprising a barrel body (12), a barrel lid (14) having an outer periphery, and a clamping ring (16), in which the barrel body (12) has an open upper end defined by an upper rim (18) having an upstanding first sealing web (24), and the barrel lid (14) includes an inverted-U-shaped rim (20) defined by an upper end having an outer downwardly extending side wall (26) and a spaced inner downwardly extending side wall (28), the clamping member (16), having an upper leg (30) and a lower leg (32) and when in the clamped state engages with its upper leg (30) over the U-shaped rim (20) of the barrel lid and with its lower leg (32) under a downwardly facing surface of a radially extending part of the rim (18), near the upper end of the barrel, the improvement comprising:

a second sealing web (36) disposed on said lid 14 and extending downwardly between said outer and inner side walls (26, 28) to define a downwardly facing recess (38) between the second sealing web (36) and the inner side wall (28), and a hollow reinforcing element (54) positioned on said lid (14) adjoining and below the inner side wall (28), said reinforcing element (54) extending around said outer periphery of the lid; wherein:

the hollow reinforcing element (54) is foam-filled.

22. The lidded barrel of claim 21 wherein:

the hollow reinforcing element (54) is a prefabricated separate structure which is fused onto said lid (14).

23. In a lidded plastic barrel (10) comprising a barrel body (12), a barrel lid (14) having an outer periphery, and a clamping ring (16), in which the barrel body (12) has an open upper end defined by an upper rim (18) having an upstanding first sealing web (24), and the barrel lid (14) includes an inverted-U-shaped rim (20) defined by an upper end having an outer downwardly extending side wall (26) and a spaced inner downwardly extending side wall (28), the clamping member (16), having an upper leg (30) and a lower leg (32) and when in the clamped state engages with its upper leg (30) over the U-shaped rim (20) of the barrel lid and with its lower leg (32) under a downwardly facing surface of a radially extending part of the rim (18), near the upper end of the barrel, the improvement comprising:

a hollow reinforcing element (54) positioned on said lid (14) adjoining and below the inner side wall (28), said reinforcing element (54) extending around said outer periphery of the lid, wherein the hollow reinforcing element (54) is foam-filled.

24. The lidded barrel of claim 23 wherein:

the hollow reinforcing element (54) is a prefabricated separate structure which is fused onto said lid (14).

25. The lidded barrel of claim 23 wherein:

the inner side wall (28) of said lid (14) includes a radially outwardly facing surface and a bottom end;

the hollow reinforcing element (54) includes:

i) an outer ring member (64) having a lower end and a radially outwardly facing surface forming a continuation of the radially outwardly facing surface of said inner inside wall 28, and ii) an inner ring member (66) spaced from said outer ring member (64) and having a lower end connected to the lower end of the outer ring member (64); and said reinforcing element (54) has a radial thickness greater than the thickness of said inner side wall (28).

26. The lidded barrel of claim 25 wherein:

said lid (14) includes an inner lid panel (42) spaced from the rim (18) of said lid (14) by a U-shaped upwardly facing groove (44) formed in said lid (14);

said groove (44) includes a radially extending base (46) having a first end connected to said inner lid panel (42) and a second end connected to the bottom end of said inner side wall (28); and said inner ring member (66) is connected at an upper end thereof to said base (46) between said first and second ends.

* * * * *